United States Patent [19]

Osgood

[11] Patent Number: 4,834,239

[45] Date of Patent: May 30, 1989

[54] PACKAGE FOR FLUORESCENT LAMPS

[75] Inventor: John H. Osgood, Hyannis, Mass.

[73] Assignee: Packaging Industries Group, Inc., Hyannis, Mass.

[21] Appl. No.: 166,816

[22] Filed: Mar. 1, 1988

[51] Int. Cl.[4] ..... B65D 85/42

[52] U.S. Cl. ..... 206/418; 206/419; 206/443; 206/490; 206/462

[58] Field of Search ..... 206/418, 419, 420, 443, 206/486, 490, 461, 462

[56] References Cited

U.S. PATENT DOCUMENTS

| | | | |
|---|---|---|---|
| 2,382,240 | 8/1945 | Lesavoy et al. | 206/418 |
| 2,692,077 | 10/1954 | Kuhlman | 206/418 |
| 2,897,252 | 7/1959 | Martin | 206/418 |
| 2,984,345 | 5/1961 | Emery | 206/419 |
| 3,168,953 | 2/1965 | Omer, Jr. | 206/419 |
| 3,973,675 | 8/1976 | Brand et al. | 206/418 |
| 4,392,389 | 7/1983 | Eckstein et al. | 206/443 |
| 4,613,042 | 9/1986 | Aeschliman | 206/419 |

FOREIGN PATENT DOCUMENTS

| | | | |
|---|---|---|---|
| 2216703 | 10/1973 | Fed. Rep. of Germany | 206/419 |
| 1209704 | 10/1970 | United Kingdom | 206/419 |

*Primary Examiner*—David T. Fidei

*Attorney, Agent, or Firm*—Berman, Aisenberg & Platt

[57] ABSTRACT

A package for a fluorescent tube includes a substantially rigid blister surrounding and spaced from conducting pins extending from an end of the tube. The blister is spaced from the pins and has a surrounding shoulder which rests on the end of the tube so that impact on the blister is transferred to the end surface of the tube and does not damage the pins. The tube ends may pass through apertures in a tube-separating card attached to the blisters, and the card may be adapted for receiving identifying graphics.

Blisters may also be formed into trays for use in bulk packaging of fluorescent tubes.

2 Claims, 2 Drawing Sheets

PACKAGE FOR FLUORESCENT LAMPS

FIELD OF THE INVENTION

The invention relates to packages for fluorescent lamps.

BACKGROUND OF THE INVENTION

Known packages for fluorescent lamps protect the ends of the tubes inadequately if the tubes are dropped. Conducting pins extend from a metal ferrule portion which closes the end of a tubular fluorescent lamp, and known packages often do not protect these conducting pins adequately for transportation without damage.

Skaggs, U.S. Pat. No. 4,278,169, describes a package for isolating an article having an arcuate surface from the walls of a shipping container. The packaging is formed from a strip of paperboard, but does not address the problem of protecting pins of fluorescent lamps. The patent to Armentrout, U.S. Pat. No. 3,181,699, describes a means for packaging fluorescent lamps and similar articles. The article to be packaged is either supported on a base or suspended above a base in preparation for the packaging operation. Thermoplastic film is then used to encase and shrink wrap the package. Armentrout does not describe separation of articles by packaging or particular protection of pins on the ends of a fluorescent tube.

The patent to Harrison, U.S. Pat. No. 2,828,799, describes a method for enveloping shaped objects by using a shrink-film package. Packaging of a plurality of articles in one package is not shown. The May patent, U.S. Pat. No. 3,288,279, describes a blister package for electrical components in which each component is individually packaged with cooperation between the packages for adjacent articles.

SUMMARY OF THE INVENTION

The invention is a package for at least one fluorescent lamp, such as a fluorescent tube which has a light transmitting portion, a shoulder portion at each end and means for conducting electricity, such as pins, extending from each shoulder portion. The package includes a blister having a cavity around and spaced from the pins and resting on or adjacent the shoulder portion so that if the package is dropped on its end the pins are not damaged. The shoulder portion, which may be an end surface of a metal ferrule or an insulator in contact with the end surface of the ferrule, takes the impact of the drop. The cavity is made of sufficiently rigid material that it is not substantially dented or pushed onto the pins when the package is dropped. The blister is preferably made of thermoformable plastic such as polyvinylchloride, polystyrene, or polypropylene.

In one embodiment, a blister including one or more cavities may be attached to a card having an aperture for holding the end of each tube and having a portion for receiving advertising or other graphic printed material. If the package holds more than one tube, several cavities are provided and the card or other divider holds the fluorescent tubes spaced from each other, preferably by at least one-eighth inch.

The package is suitable for use with one, two or more fluorescent lamps, and may also be used for bulk shipments. For bulk shipments the card divider is preferably omitted.

It is an object of the invention to provide a blister package for fluorescent tubes in which a cavity is spaced away from the conducting pins and rests on or adjacent the shoulder at the end of the tube.

It is another object of the invention to provide a package for protecting fluorescent lamps during transportation, suitable for packaging one or more lamps.

DETAILED DESCRIPTION OF THE INVENTION

The blister package of the invention for one or more fluorescent lamps, such as fluorescent tubes, protects the pins on the end of the tube by providing a pin-protecting cavity portion spaced away from the pins. Pins of fluorescent lamps other than tubes may be protected similarly, as will be apparent to one skilled in the art.

The blister package further includes a portion substantially surrounding each cavity which is positioned adjacent, but not necessarily in contact with, the end cap of the fluorescent tube (which may be a metal ferrule having an insulating end portion) from which the pins extend. If the package is dropped on its end, the cavity and surrounding portion are sufficiently rigid to transmit any pressure of impact to the end face of the ferrule instead of to the pins.

Each cavity is preferably approximately cylindrical in shape, and adjacent cavities may optionally be attached to each other by at least one connecting rib. Also, in a two-cavity blister, for example, the cavities may optionally be connected by an opening therebetween. Other shapes will be apparent to one skilled in the art.

The fluorescent tubes are held at a separation of between about one-sixteenth inch to one-half inch, and preferably, for example, at least one-eighth inch from each other, and to maintain this spacing the tubes may be inserted into the pin-protecting cavities through apertures in a tube-separating card to which the blister is attached. The fluorescent tube receiving portion of the card may optionally by extended to form a section which is hinged through 90 degrees to lie along the length of the tube and on which graphics relating to the tube may be printed. The other end of the card is preferably bent back, in the same direction as the first bend, and shaped to fit between the tubes, thus maintaining the spacing of the tubes at least one-eighth inch apart from each other. The tubes are held together at the other end by a second blister structure optionally also including a card separator through which the tubes are inserted.

In another embodiment of the invention, blister material is formed into trays, each tray including a plurality of cavities for use in bulk transportation of fluorescent tubes. A tray of cavities is placed over each end of an array of, for example, thirty tubes for holding them securely in a carton used for bulk transportation.

Figure 1:
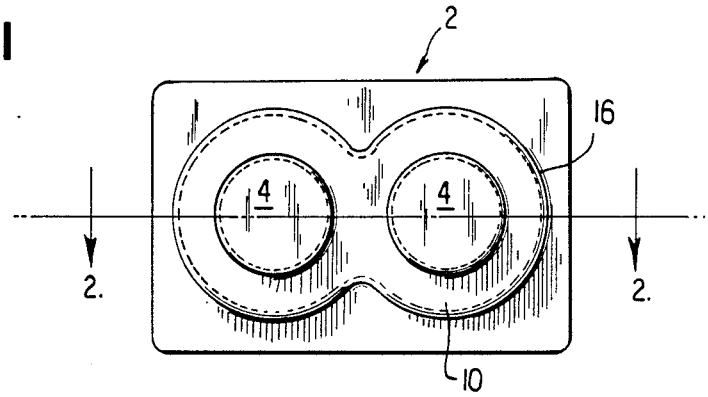
FIG. 1 is an end plan view of a blister package of the invention.
Figure 2:
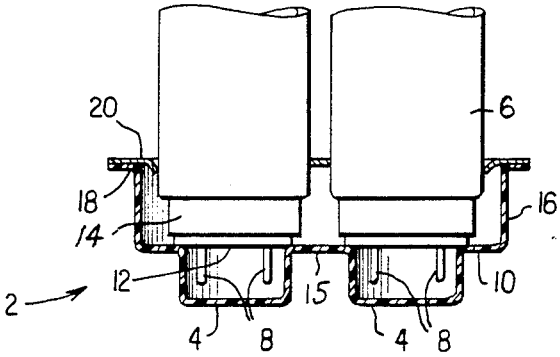
FIG. 2 is a section taken on line 2—2 of FIG. 1, showing the package used on two tubes.

Referring to the Figures, in which like numerals represent like parts, FIGS. 1 and 2 shows views of a package for two fluorescent tubes. Blister structure 2 has two cavity portions 4 for receiving pins 8 of fluorescent tubes 6. Blister structure 2 is made of sufficiently rigid material that if the package is dropped on its end, the resulting shock of the impact is absorbed by the tube structure allowing blister structure 2 to substantially retain its shape without being forced into contact with the pins. Any shock resulting from dropping the package is transmitted through the blister structure to end insulator 12 and/or metal ferrule 14 of tube 6. The ferrule provides a sturdy platform for non-injuriously receiving the shock. End insulator 12 may substantially cover the end surface of metal ferrule 14, or may comprise the portions of the ferrule immediately surrounding the pins.

Each cavity portion 4 extends from a shoulder portion 10 which lies adjacent but not necessarily in contact with insulating end surface 12 of ferrule 14 or adjacent the ferrule itself and transmits the force of impact thereto. In a two-tube package, shown in FIGS. 1 and 2, the tubes are separated by central portion 15 so that they are spaced at least one-eighth inch away from each other. Portion 16 extends adjacent sides of the ferrule and may be sufficiently close to touch sides of tubes 6. Portion 16 optionally terminates in surface 18 for receiving separator 20 which may be a card separator. Cavities 4 may optionally be connected by a rib structure or by an opening between the cavities.

Figure 3:
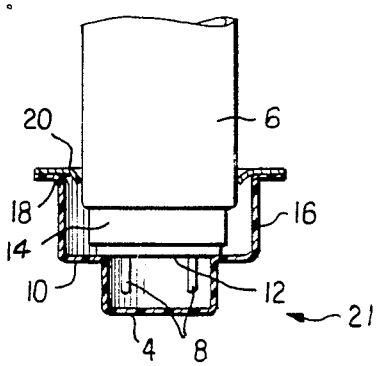
FIG. 3 is a sectional view, similar to FIG. 2, for a one-tube package.

FIG. 3 shows a blister structure 21 similar to blister structure 2, shown in FIGS. 1 and 2, but adapted for holding a single fluorescent tube 6. FIG. 3 shows an alternative embodiment in which cavity 4 extends from shoulder portion 10 which lies adjacent to but not touching end surface 17 of ferrule 14. As illustrated, in a different type of end structure known for a fluorescent tube, insulator portions surrounding each pin 8 cannot be seen in this view but extend from an insulator body located inside ferrule 14 to provide an insulating surface around each pin 8 coplanar with end surface 17 of ferrule 14. If the fluorescent tube is dropped on its end, impact on substantially rigid cavity portion 4 pushes blister structure 21 toward tube 6 so that the force of impact is transmitted through shoulder portion 10 to end surface 17 of ferrule 14, without damaging pins 8. In this embodiment, shoulder portion 10 may be pushed into contact with end surface 17, on impact. Side portion 16 of cavity 21 terminates in surface 18 for receiving card 20.

The embodiments shown in FIGS. 2 and 3 are freely interchangeable so that blister structure 2, for two tubes may be spaced away from the ferrules of the tubes, and any known fluorescent tube end structure may be used with the cavity structure of the invention.

Figure 4:
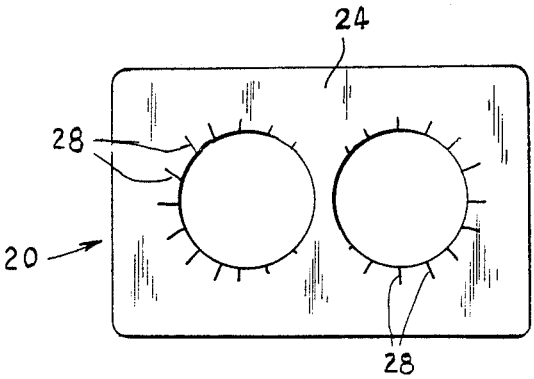
FIG. 4 is a plan view of a tube separator of the invention.
Figure 5:
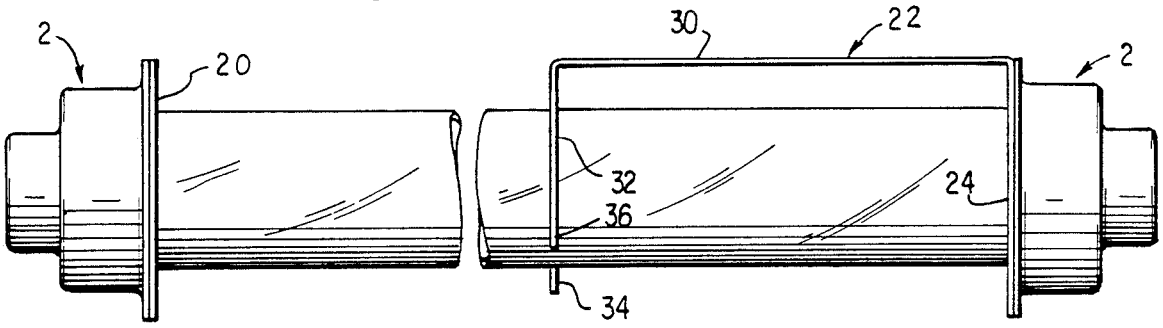
FIG. 5 is a plan view of another tube separator of the invention.

Card 20 is illustrated in FIG. 4 and an alternative embodiment, card 22 is illustrated in FIG. 5. Card 20 may be used at one end of the tube or pair of tubes and card 22 may be used at the other end, or both ends may be separated using card 20 or both ends may be separated using card 22, according to choice.

In a preferred embodiment for holding two fluorescent tubes, card 20, shown in FIG. 4, has a portion 24 having two circular apertures 26 therein through which the tubes are placed. Each aperture 26 has a diameter a little smaller than the diameter of the fluorescent tube to be inserted therethrough, and a plurality of slits 28 extend from the circumference of each aperture 26 for flexibly enlarging the aperture and holding the tube securely once it has been pushed therethrough. Slits 28 are generally not located between the apertures to avoid weakening the card structure.

Figure 6:
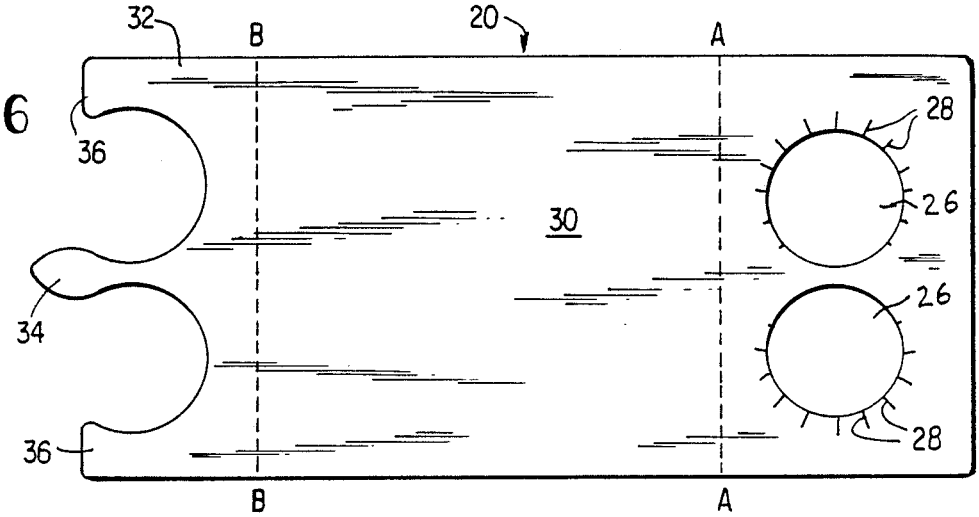
FIG. 6 is a side view of a tube having a package of the invention attached to each end.

Card 22, shown in FIG. 5, is similar to card 20 but includes an extended portion 30 for receiving identifying graphics and a portion for engaging the separated tubes. In a non-limiting example, tube-receiving apertures 27 have slits 28 extending from angular portions of the perimeter of apertures 27 in a direction toward body of card 22, to avoid weakening the card structure by the slits either between the apertures or at the edges of the card, if edge portions 29 around apertures 27 should be narrow. Card 22 is bent at a 90 degree angle along line A—A and again through another 90 degree bend in the same direction at line B—B so that surface 30 which extends along the length of the tubes is of sufficient size and surface characteristics to receive identifying graphics thereupon. Portion 32 which is bent back towards the tube, as shown in FIGS. 5 and 6, is cut so that central portion 34 extends and fits snugly between the spaced apart tubes and portions 36 protect each outer side of the tubes. It will be readily apparent that cards 20 and 22, illustrated in FIGS. 4 and 5, may be divided longitudinally into two cards, each suitable for supporting a single tube, for use when tubes are sold singly.

Figure 7:
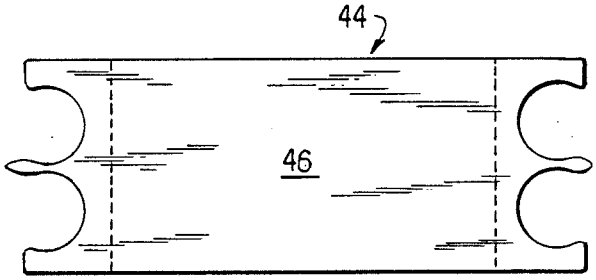
FIG. 7 is a plan view of yet another tube separator of the invention.

In a non-limiting example, two tubes may be packaged together having a card 20 at one end and a card 22 at the other end, as shown in FIG. 6. Alternatively, a card 20 may be used at both ends, and if so, card 44, illustrated in FIG. 7, may be used to support graphics on central portion 46 thereof. It will be seen that card 44 may be positioned anywhere along the length of tubes which are held spaced apart by cards 20 attached to blister portions 2 at each end thereof. FIG. 6 shows a side view of a tube having a card 20 at one end and a card 22 at the other end.

It is general marketing practice that fluorescent tubes are partially or fully enveloped in a transparent wrap, which may be a shrink wrap or other type of transparent wrap. The inventive package descriped herein may be used together with any such partial or complete covering wrap.

The fluorescent tube end protector blister packages described herein are substantially securely attached to the tubes since the tubes engage the flexible portions cut from the apertures in the cards. If, however, these apertures each have a diameter larger than the diameter of the tube passing therethrough, or if the card portion is omitted, a shrink-wrap or other wrap will be necessary to hold the protective cavityincluding blister portions securely onto the ends of the tubes.

Figure 8:
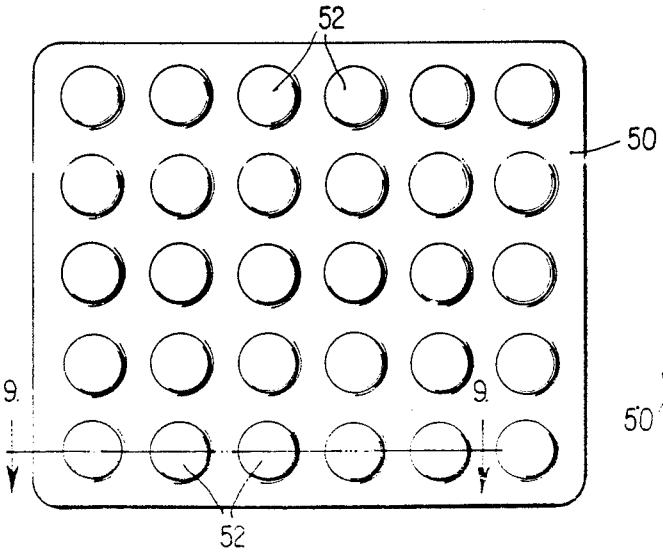
FIG. 8 is an end plan view of a blister sheet for holding 30 tubes.
Figure 9:
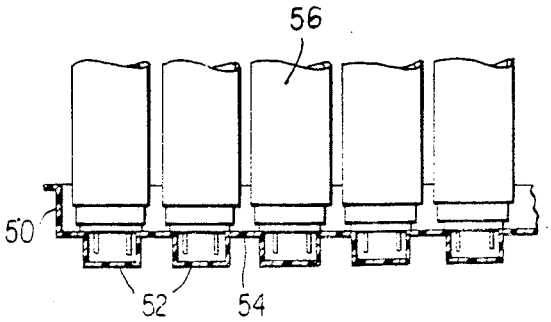
FIG. 9 is a sectional view taken on line 9—9 of FIG. 8, showing use with tubes.

In another embodiment of the invention, suitable for bulk packaging of fluorescent tubes, the blister portion may be a tray of cavities, similar to those described above. FIGS. 8 and 9 each show a tray of cavities having a capacity of thirty tubes. Other shapes and sizes will be apparent to one skilled in the art. Tray 50, shown in FIGS. 8 and 9, has a plurality of cavities 52 therein separated by ferrule contacting portions 54 for holding tubes 56 adequately spaced apart from each other. A tray 50 may be placed at each end of a packaging carton and up to thirty tubes inserted appropriately therein with the pins at the ends of each tube 56 being located spaced from side walls of cavities 52. Trays 50 having cavities 52 will protect the pins from damage should the bulk transportation carton be dropped on its end, similarly to the end packages discussed above. Tube separating cards, or other tube separators are optional.

Any material suitable for the packaging may be used. In non-limiting example, the blisters may be any thermoformable plastic capable of forming a substantially rigid blister; formed paper, paper pulp or fiber; molded plastic; stamped, formed, cast or turned metal; turned wood; turned or otherwise shaped vegetable material, for example, wood or corn cobs; or suitably treated fabric materials. Preferred materials are polyvinylchloride, polystyrene, or polypropylene.

Any substantially stiff material may be used for the card portion, such as, in non-limiting example, paper, formed or molded pump or other vegetable material, formed, scored or molded plastic or formed wood, as appropriate to the size of the packaged articles. Preferred card material is stiff paper stock which has one side treated to enhance printing.

While the invention has been described with respect to certain embodiments thereof, it will be appreciated that variations and modifications may be made without departing from the spirit and scope of the invention.

What is claimed is:

1. A package for at least one fluorescent lamp, said at least one lamp comprising a light transmitting portion having a shoulder portion at each end thereof and means for conducting electricity extending from said shoulder portion, wherein said package comprises means for contacting said shoulder portion, and means for protecting the electricity conducting means comprising blister portions spaced away from said electricity conducting means and attached to said shoulder contacting means.

wherein said protecting means is sufficiently rigid that the force of an impact on the end of the package spaced from the conducting means is transmitted to the at least one shoulder portion without damaging the conducting means, and the means for contacting a shoulder portion at an end of each lamp and for spacing away from the conducting means extending from each of said shoulder portions comprises cavity means, said cavity means being unitarily formed and sufficiently rigid that the force of an impact on the end of the cavity means is transmitted to at least one shoulder portion without damaging the conducting means;

wherein said package further comprises sheet means, atatched to the blister portions, for further supporting the lamp.

2. A package of claim 1 wherein the sheet means comprises an aperture for receiving each lamp therethrough.

* * * * *